US008022324B2

(12) United States Patent
Liu

(10) Patent No.: US 8,022,324 B2
(45) Date of Patent: Sep. 20, 2011

(54) METHOD OF MANUFACTURING A KEYPAD STRUCTURE HAVING A TRANSPARENT KEYCAP AND KEYPAD STRUCTURE HAVING A TRANSPARENT KEYCAP

(75) Inventor: Chang-Li Liu, Taoyuan (TW)

(73) Assignee: Ichia Technologies, Inc., Hwa-Ya Tech. Park, Gueishan, Taoyuan (TW)

( * ) Notice: Subject to any disclaimer, the term of this patent is extended or adjusted under 35 U.S.C. 154(b) by 270 days.

(21) Appl. No.: 12/555,805

(22) Filed: Sep. 8, 2009

(65) Prior Publication Data

US 2010/0307898 A1 Dec. 9, 2010

(30) Foreign Application Priority Data

Jun. 4, 2009 (TW) ..... 98118549 A

(51) Int. Cl.
*H01H 13/83* (2006.01)
*H01H 11/00* (2006.01)

(52) U.S. Cl. ..... 200/314; 29/622; 200/310; 200/313

(58) Field of Classification Search ..... 29/622; 341/22, 23, 28, 33, 34; 345/168–171, 173, 345/176; 455/157.2, 158.5; 362/24–30; 200/5 A, 516, 517, 341, 310–317
See application file for complete search history.

(56) References Cited

U.S. PATENT DOCUMENTS

| | | | | |
|---|---|---|---|---|
| 6,835,906 | B2 * | 12/2004 | Okamoto et al. | 200/341 |
| 7,049,530 | B2 * | 5/2006 | Hayashizaki | 200/5 A |
| 7,369,064 | B2 * | 5/2008 | Yeh | 341/22 |
| 7,414,213 | B2 * | 8/2008 | Hwang et al. | 200/341 |
| 7,572,023 | B2 * | 8/2009 | Chen | 362/26 |
| 7,656,314 | B2 * | 2/2010 | Muranaka et al. | 341/22 |
| 7,663,071 | B2 * | 2/2010 | Chang | 200/345 |
| 7,727,618 | B2 * | 6/2010 | Iwano | 428/204 |
| 7,759,588 | B2 * | 7/2010 | Hsu | 200/5 A |
| 7,808,487 | B2 * | 10/2010 | Taylor et al. | 345/168 |

* cited by examiner

*Primary Examiner* — Michael Friedhofer
(74) *Attorney, Agent, or Firm* — Winston Hsu; Scott Margo

(57) ABSTRACT

The present invention discloses a method of manufacturing a keypad structure having a transparent keycap and a keypad structure having a transparent keycap. A metal pattern layer is formed on a transparent resin layer of a keycap component. Two print layers are formed on a transparent resin layer of an overprint component. Two print layers and the metal pattern layer are overlapped and have a level difference in height of the total thickness of the two transparent layers. Accordingly, the figure of the keypad seems to be floated and is felt to be three-dimensional.

27 Claims, 10 Drawing Sheets

METHOD OF MANUFACTURING A KEYPAD STRUCTURE HAVING A TRANSPARENT KEYCAP AND KEYPAD STRUCTURE HAVING A TRANSPARENT KEYCAP

BACKGROUND OF THE INVENTION

1. Field of the Invention

The present invention relates to a keypad structure and a method of manufacturing the same, and more particularly, to a thin-type keypad structure having planar metal figures with three-dimensional floating effect.

2. Description of the Prior Art

Electronic products such as cell phones, personal digital assistants (PDAs) usually have keypad keyboards. In the present market, keypad keyboards are mainly categorized into metal keypad keyboards with metallic luster and common plastic keypad keyboards. Conventionally, the metallic luster and the figures such as numerals, symbols and English letters formed on the keypad keyboards are manufactured by virtue of print production or laser carving method, whereas only two-dimensional flat visual effect may be achieved. Also, the aforementioned figures may be stripped off with ease and damaged due to frequent pressings. For this reason, in order to enhance the protection for the figures and increase three-dimensional beauty as well, the technology for forming figures on the bottom surface of the keycap component has developed.

For example, Taiwan patent number M353416 discloses a keypad keyboard having metal figures. As illustrated in FIG. 1, the metal figures are covered by the outer transparent layer. The keypad keyboard includes a substrate 1 and a plurality of keycaps 2. The substrate 1 has a first surface 11 and a second surface 12 on the opposite sides, and the substrate 1 may be soft material such as rubber, but not limited thereto. Pluralities of plungers 13 are disposed on the second surface 12 of the substrate 1. Also, the keycap components 2 are respectively disposed on the top of the substrate 1. In this embodiment, the keycap components 2 are disposed on the top of the first surface 11 of the substrate 1. Each of the keycap components 2 has at least a metal FIG. 21 and an outer transparent layer 22, and the metal FIG. 21 with micro-shaped protrusions are disposed on the surface corresponding to the transparent layer 3 and disposed on the top of the first surface 11 of the substrate 1. The outer transparent layer 22 covers metal FIG. 21, such that the metal FIG. 21 are embedded inside the outer transparent layer 22. The metal FIG. 21 include numerals, symbols and English letters or the combination of the aforementioned metal figures, but are not limited thereto. In addition, the thickness t of the metal FIG. 21 is between 0.04 and 0.07 mm, and is preferably between 0.05 and 0.06 mm for optimized effect. Also, the outer transparent layer 22 is formed by UV-cured resin, and the plungers 13 of the substrate 1 correspond to the bottom of the keycap components 2.

The keypad keyboards of the electronic products have to be relatively thin and small for the devices with reduced size and weight as desired so as to accord with the demand of the market. Consequently, there is still a need for a novel keypad with a thin and small structure.

SUMMARY OF THE INVENTION

One object of the present invention is to provide a keypad structure having a transparent keycap and the method of manufacturing the same. Such keypad structure may be relatively thin and have small shape. In addition, even if the pattern of the keypad is almost formed of planar metal, the keypad pattern seems to be floated and is felt to be three-dimensional. Also, the color of overprints may be adapted optionally, for instance, to allow the pattern on the keypad to show eclipse effect.

According to an embodiment of the method of manufacturing a keypad structure having a transparent keycap of the present invention, the method includes following steps. The steps of forming a keycap component include providing a first transparent resin layer including a first surface and a second surface, forming a first metal pattern layer on the first surface of the first transparent resin layer, and forming the keycap layer covering the first metal pattern layer on the first surface of the first transparent resin layer. The steps of forming an overprint component include providing a second transparent resin layer including a third surface and a fourth surface, forming a first print layer covering the fourth surface, a pattern of the first print layer complementing a pattern of the first metal pattern layer, and forming a second print layer covering the first print layer, wherein the pattern of the first print layer and the pattern of the first metal pattern are skeleton pattern and hollowed pattern respectively. The steps of providing a light guide plate include a fifth surface and a sixth surface. Also, the keycap component, the overprint component, the light guide are bonded for assembly, wherein the second surface of the first transparent resin layer and the third surface of the second transparent resin layer face each other, and the fourth surface of the second transparent resin layer and the fifth surface of the light guide plate face each other.

According to an embodiment of the keypad structure having a transparent keycap of the present invention, the keypad structure includes a keycap component and an overprint component. The keycap component includes a first transparent resin layer including a first surface and a second surface, a first metal pattern layer disposed on the first surface of the first transparent resin layer, and a keycap layer disposed on the first surface of the first transparent resin layer and covering the first metal pattern layer. The overprint component includes a second transparent resin layer including a third surface and a fourth surface, a first print layer covering the fourth surface, a pattern of the first print layer complementing a pattern of the first metal pattern layer, and a second print layer covering the first print layer, wherein the pattern of the first print layer and the pattern of the first metal pattern are a skeleton pattern and a hollowed pattern respectively. The keycap component and the overprint component are bonded together, and the second surface of the first transparent resin layer and the third surface of the second transparent resin layer face each other.

According to another embodiment of the keypad structure having a transparent keycap of the present invention, the embodiment includes a circuit board including a plurality of metal domes disposed thereon, a transparent soft resin or rubber layer is bonded to the metal domes of the circuit board via a plurality of plungers, a plurality of keycap components and a plurality of overprint components. Each of the keycap components includes a first transparent resin layer including a first surface and a second surface, a first metal pattern disposed on the first surface of the first transparent resin layer, and a keycap layer disposed on the first surface of the first transparent resin layer and covering the first metal pattern layer. Each of the overprint components includes a second transparent resin layer including a third surface and a fourth surface, a first print layer covering the fourth surface and comprising a pattern of the first print layer complementing a pattern of the first metal pattern layer wherein the pattern of the first print layer and the pattern of the first metal pattern are a skeleton pattern and a hollowed pattern respectively, and a second print layer covering the first print layer, wherein the fourth surface and the transparent soft resin or rubber layer face each other. The overprint components are disposed on the transparent soft resin or rubber layer respectively corresponding to the plungers. The keycap components are disposed on the overprint components respectively, and the second surface of the first transparent resin layer and the third surface of the second transparent resin layer face each other.

These and other objectives of the present invention will no doubt become obvious to those of ordinary skill in the art after reading the following detailed description of the preferred embodiment that is illustrated in the various figures and drawings.

DETAILED DESCRIPTION

The method of manufacturing a keypad structure having a transparent keycap according to the present invention includes steps of forming a keycap component, steps of forming an overprint component, and steps of providing a light guide plate, and a step or steps of bonding the keycap component, the overprint component, and the light guide plate for assembly, such that a keypad structure having a transparent keycap is therefore formed.

Figure 1:
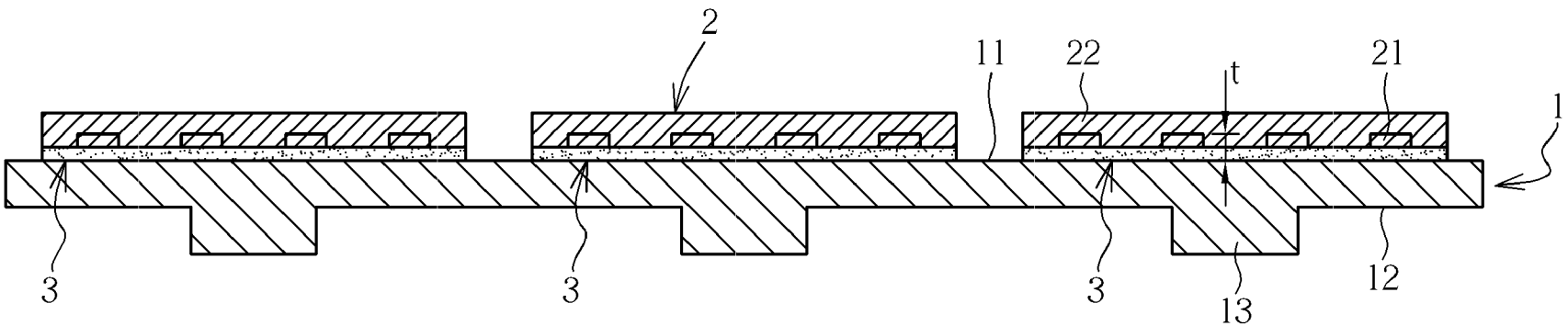
FIG. 1 illustrates a conventional keypad keyboard having metal figures.
Figure 2:
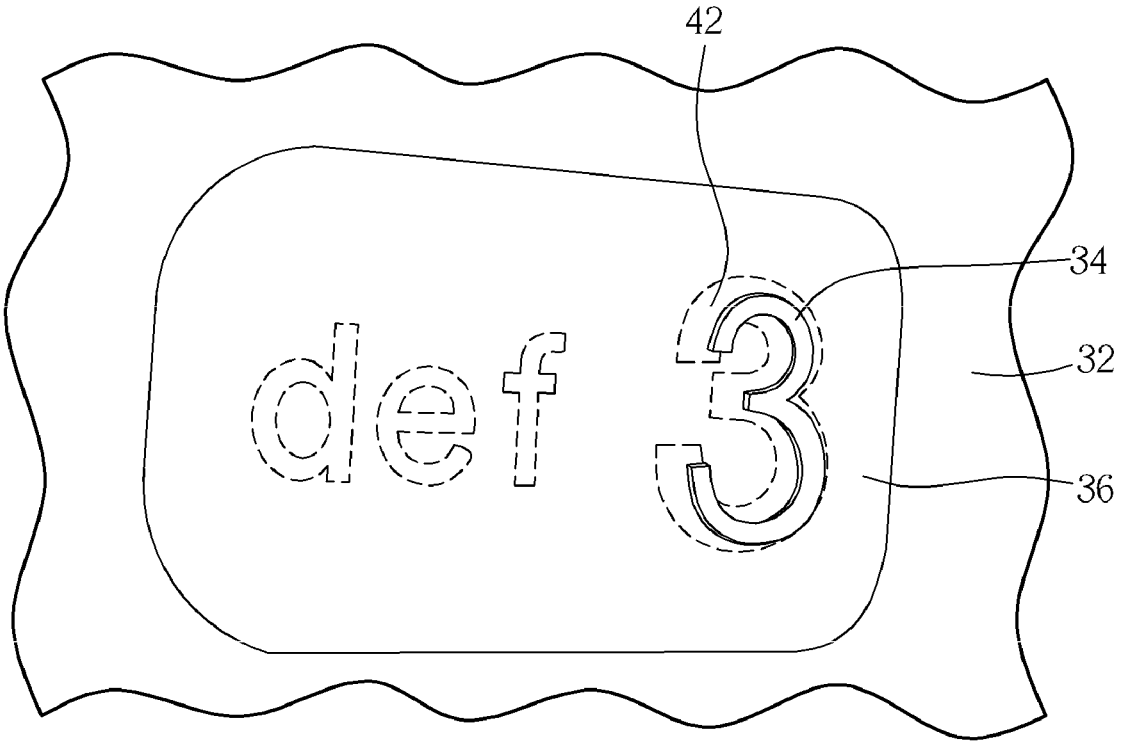
FIG. 2 and FIG. 3 are diagrams respectively illustrating appearance and the dismantling of a portion of the keypad structure according to an embodiment and should be referred together.
Figure 3:
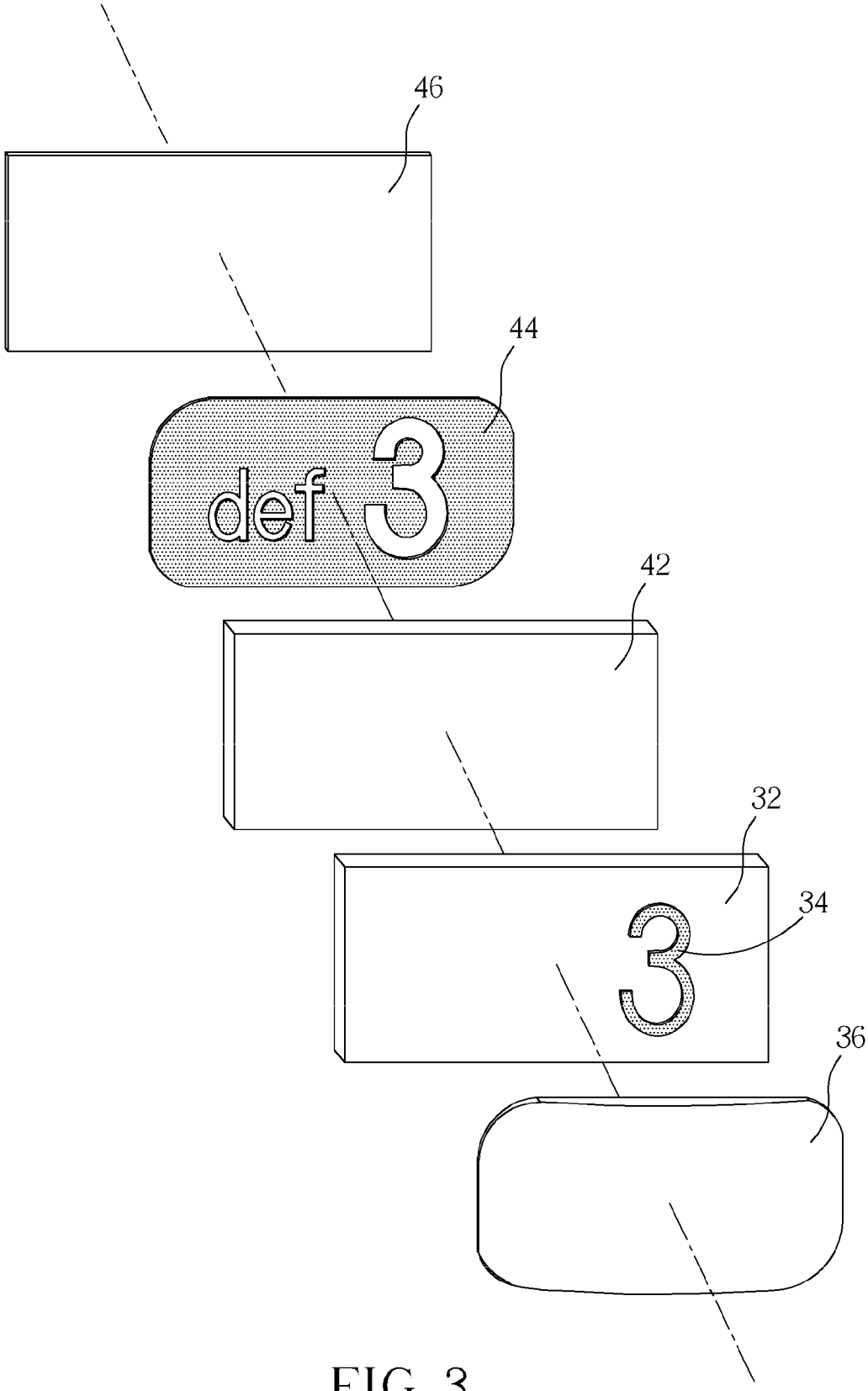

Each of the steps is detailed as follows. FIG. 2 and FIG. 3 are diagrams respectively illustrating parts of appearance and the dismantling of a keypad structure according to an embodiment and should be referred together. The step of forming a keycap component includes providing a first transparent resin layer 32, but the thickness of the first transparent resin layer 32 is not particularly limited and may be determined as required. Also, the material may be transparent resin, in an embodiment, the transparent resin may be for example PC (polycarbonate) or PET (poly(ethyleneterephthalate)). Additionally, herein, the meaning of the word "transparent" includes transmittance and semi-transmittance. The color of the transparent resin is not particularly limited. Thereafter, a first metal pattern layer 34 is formed on a surface of the first transparent resin layer 32. The metal pattern may be numerals, symbols, English letters or the combination of the aforementioned, but is not limited thereto. The way of forming the first metal pattern layer may be as follows. For instance, a metal nameplate layer is bonded to the surface of the first transparent resin layer, a metal paint is printed on the surface of the first transparent resin layer, or a metal layer is formed on the surface of the first transparent resin layer by virtue of the sputtering process. The thickness of the first metal pattern layer 34 is not limited but may be determined as required. In a preferred embodiment of a thin-type keypad, the first metal pattern layer 34 may be 0.05 mm or 0.1 mm, for instance. The material of the first metal pattern layer 34 is metal e.g. aluminum, but is not limited thereto, or paints including metals. The first metal pattern layer 34 may be used to visualize the letter or figures on the keypads. Afterwards, a keycap layer 36 is formed on the same surface of the first transparent resin layer so as to cover the first metal layer 34. As for the method of forming the keycap layer 36, for example, a UV-curable resin is dispensed on the first transparent resin layer by virtue of dispensing technology, such that the UV-curable resin covers the first metal pattern later 34 and therefore becomes a keycap shape. Subsequently, the UV-curable resin is solidified by virtue of the irradiation of a UV light so as to form UV-cured resin bond (so-called GM bond). Also, the shape is not limited and may be determined as required.

The steps of forming an overprint component include providing a second transparent resin layer 42. The thickness is not particularly limited and may be determined as required. The material may be a transparent resin, and the color is not limited particularly. The material of the second transparent resin layer 42 and that of the first transparent resin layer 32 may be identical or different. Afterwards, a first print layer 44 is formed on the surface of the second transparent resin layer 42. A pattern of the first print layer 44 complements a pattern of the first metal pattern layer 34, wherein the pattern of the first print layer and the pattern of the first metal pattern are skeleton pattern and hollowed pattern respectively. Therefore when the first metal pattern layer 34 is skeleton shape, the first print layer 44 corresponding to the position of the skeleton shape is hollowed. Or, when the first metal pattern layer 34 is hollowed, the first print layer 44 corresponding to the position of the hollowed pattern has an entity pattern. That is to say, the portion of the first print layer 44 disposed on the position of the second transparent resin layer 42 non-corresponding to the first metal pattern layer 34 may provide light shielding effect. Then, a second print layer 46 is formed to cover the first print layer 44. In such a case, the first print layer 44 corresponding to the blank pattern portion of the first metal pattern layer 34 may cover the second print layer 46. Consequently, by virtue of viewing another surface of the second transparent resin layer 42, the portion of the second print layer 46 which is not shielded by the first print layer may be viewed. After stacking the keycap component and the overprint component, the portion of the second print layer 46 which is not shielded by the first print layer 42 is exposed under the first metal pattern layer 34, such that the pattern of the first metal pattern layer 34 is set off by the second print layer 46. The first print layer 44 and the second print layer 46 may be formed respectively by virtue of print paints or ink layer, whereas the color of the first print layer 44 and the color of the second print layer 46 may be identical or different. In addition, the first print layer 44, the second print layer 46 and the first metal pattern layer 34 may be adjusted as required but are not limited particularly. Moreover, in the present invention, it is not limited to only two print layers, and more print layers may be formed so as to provide desirable colors and effect.

In an embodiment of manufacturing a thin-type keypad of the present invention, the thickness of the first transparent resin layer and the thickness of the second transparent resin layer may be for example 0.125 mm respectively. Or, the thickness of the first transparent resin layer may be 0.1 mm, and the thickness of the second transparent resin layer may be 0.4 mm.

In the step of providing a light guide plate (not shown in FIG. 2 and FIG. 3), the surface such as the bottom surface near the plunger of the light guide plate may have microstructures so as to enhance the function of guiding light. One or pluralities of light emitting diode chips are disposed on a side of the light guide plate, and lights introduced by the light guide plate become the backlight of the keypads.

At last, the keycap component, the overprint component, and the light guide plate are bonded for assembly. Another surface having no first metal pattern layer and keycap layer of the first transparent resin layer 32 and another surface having no first print layer and no second print layer of the second transparent resin layer 42 face each other, and one surface having a first print layer 44 and a second print layer 46 of the second transparent resin layer 42 and one face of the light guide plate face each other. The way for assembly includes the step of bonding the keycap component, the overprint component and the light guide plate by virtue of using an adhesion layer (such as an adhesive glue or a double-sided adhesive tape) between the keycap component and the overprint component and an adhesion layer between the overprint component and the light guide plate respectively for bonding. Also, the adhesion layer may be transparent. In addition, other components may be disposed between theses two components without particular limitation.

After assembly, because the pattern of the first print layer 44 and the pattern of the first metal pattern layer 34 are complementary, the second print layer 46 is visible (exposed) via the hollowed pattern of the first print layer 44. Also, after stacking the keycap component and the overprint component from top to bottom, the first metal pattern layer 34 and the second print layer 46 are stacked to each other and have a difference in height of the total thickness of the two transparent resin layers. In such a case, the planar figures or pattern seem to be floated and is felt to be three-dimensional. In addition, since the first print layer 44 has a light-shielding effect to the second print layer 46, the first metal pattern layer 34 is accordingly set off and viewed especially under the illumination of the backlight. For instance, if the overprint layer is red, the eclipse effect with beauty may be viewed by virtue of the illumination of the backlight.

In addition, a second metal pattern layer is formed on another surface having no first print layer and no second print layer of the second transparent resin layer. Also, the second metal pattern layer has a hollowed pattern corresponding to the first metal pattern layer. Moreover, a gap may be formed between the second metal pattern layer and the first metal pattern layer in a projection view along the stacking direction of the second metal pattern layer and the first metal pattern layer, and a part of the first print layer or a part of the second print layer may be visible via the gap to a user.

A plurality of keycap components may be formed on the same substrate when manufacturing the keycap component. For instance, the whole keypad such as mobile phone keypad may be shaped according to the keypad design, or the whole keypad may be shaped by virtue of a plurality of single keypads. Similarly, the aforementioned method may be utilized to manufacture the overprint component. Accordingly, two types of punching processes are provided. As for the first way for punching, the keycap component and the overprint component are firstly punched respectively so as to form a keypad shape and bonded to the light guide plate afterwards for assembly. As for the second way for punching, the keycap component and the overprint component are firstly bonded together and punched so as to form a plurality of single keypads, and the single keypads are bonded to a transparent rubber layer and a light guide plate for assembly, wherein the transparent rubber layer is disposed between the single keypads and the light guide plate.

Moreover, another surface of the light guide plate is bonded to a circuit board. The circuit board includes at least a metal dome. A plunger is bonded to the other surface of the light guide plate, and the light guide plate is bonded to the metal dome of the circuit board via plunger. Or, the other surface of the light guide plate and the plunger are formed integrally, and therefore the light guide plate is bonded to the metal dome of the circuit board via the plunger.

Figure 4:
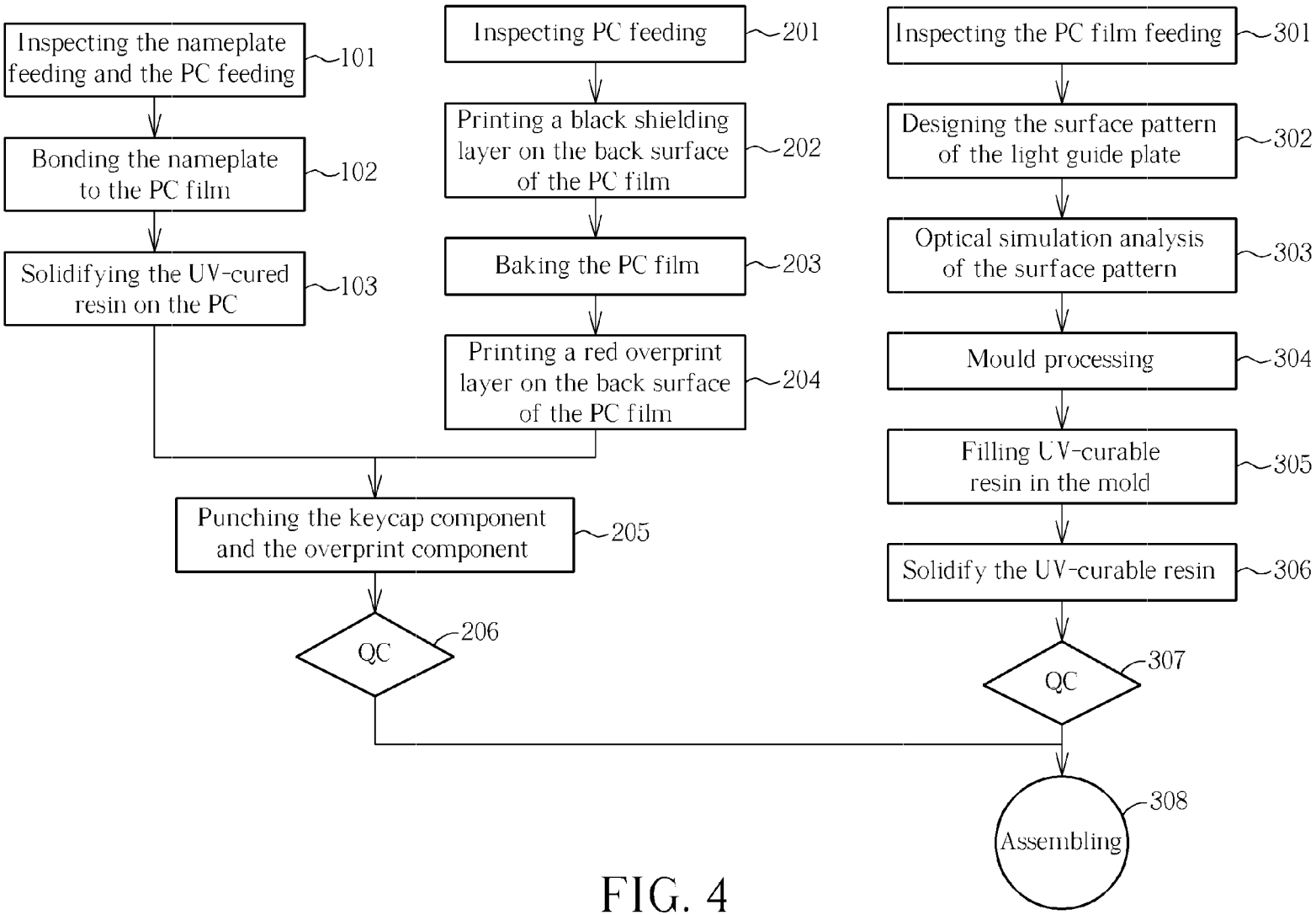
FIG. 4 is a flowchart illustrating the first embodiment of a method of manufacturing the keypad structure having a transparent keycap according to the present invention.

Several embodiments are listed as follows. FIG. 4 is a flowchart illustrating the first embodiment of a method of manufacturing the keypad structure having a transparent keycap according to the present invention. As illustrated in FIG. 4, in the step of forming a keycap component, firstly, step 101 is performed for inspecting the nameplate feeding and the PC feeding, and a PC film is provided as a first transparent resin layer. Step 102 is performed to bond the nameplate to the PC film. Step 103 is performed to solidify the UV-cured resin on the PC film so as to form a keycap layer for covering the nameplate. Accordingly, the keycap component is formed. In the step of forming the overprint component, firstly, step 201 is performed to inspect PC feeding, such that PC film is provided as the second transparent resin layer. Step 202 is performed to print a black shielding layer serving as a first print layer on the back surface of the PC film. Step 203 is performed to bake the PC film, whereas the step is determined according to the property of the first print layer. Step 204 is performed to print a red overprint layer serving as a second print layer on the back surface of the PC film. In such a case, the manufacture of the overprint component is accordingly finished. Step 205 is performed so that the keycap component and the overprint component are punched respectively so as to form a mobile phone keypad shape. The step 206 is performed for quality control (QC). In the step of providing the light guide plate, firstly, step 301 is performed to inspect the PC film feeding. Step 302 is performed to design the surface pattern of the light guide plate. Step 303 is performed for the optical simulation analysis of the surface pattern. The step 304 is performed for mould processing so as to form a mold having a light guide plate and a plunger shape integrally. Step 305 is performed to fill UV-curable resin in the mold. Step 306 is performed to solidify the UV-curable resin for forming pattern by virtue of the irradiation of the UV lights. Furthermore, step 307 is performed for quality control. Afterwards, the step 308 is performed to assemble the keycap component, the overprint component and the light guide plate so as to form a keypad structure.

Figure 5:
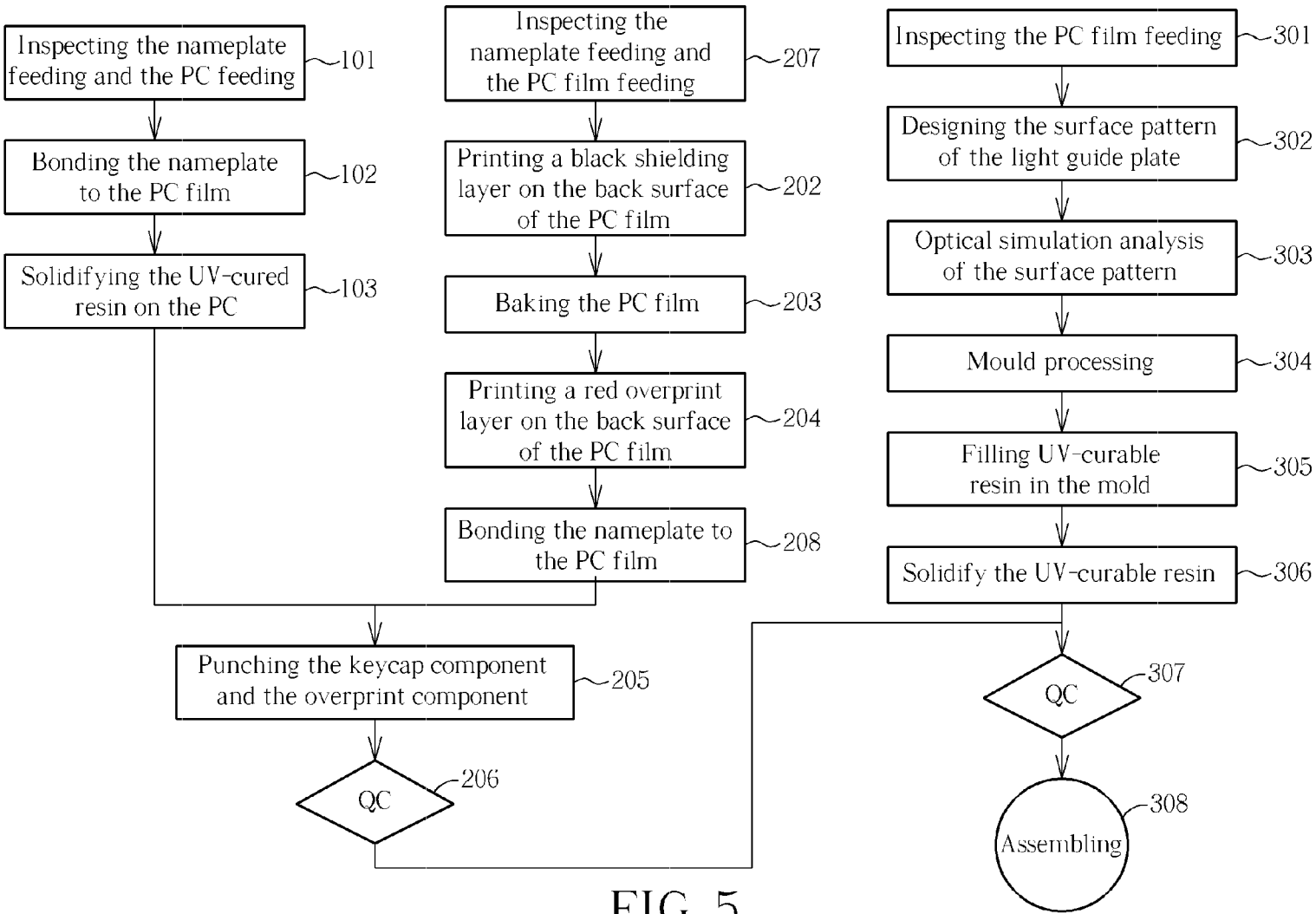
FIG. 5 is a flowchart illustrating a second embodiment of a method of manufacturing keypad structure having a transparent keycap according to the present invention.

FIG. 5 is a flowchart illustrating the second embodiment of a method of manufacturing keypad structure having a transparent keycap according to the present invention. In this embodiment, the keypad structure has two metal pattern layers. The step of forming the keycap component is identical to that of forming the first embodiment illustrated in FIG. 4. In the step of forming the overprint component, firstly, step 207 is performed to inspect the nameplate feeding and the PC film feeding so as to provide the PC film serving as a second transparent resin layer and provide the nameplate serving as a second metal pattern layer. Afterwards, steps 202, 203 and 204 are performed as described in the first embodiment. Then, step 208 is performed so that the nameplate is bonded to the PC film. Then, step 205 is performed to punch the keycap component and the overprint component respectively to form the mobile phone keypad shape. Step 206 is performed for quality control (QC). The step of providing the light guide plate is identical to the first embodiment illustrated in FIG. 4. Furthermore, step 307 is performed for quality control. At last, step 308 is performed to assemble the keycap component, the overprint component and the light guide plate after the punching so as to form a keypad structure.

Figure 6:
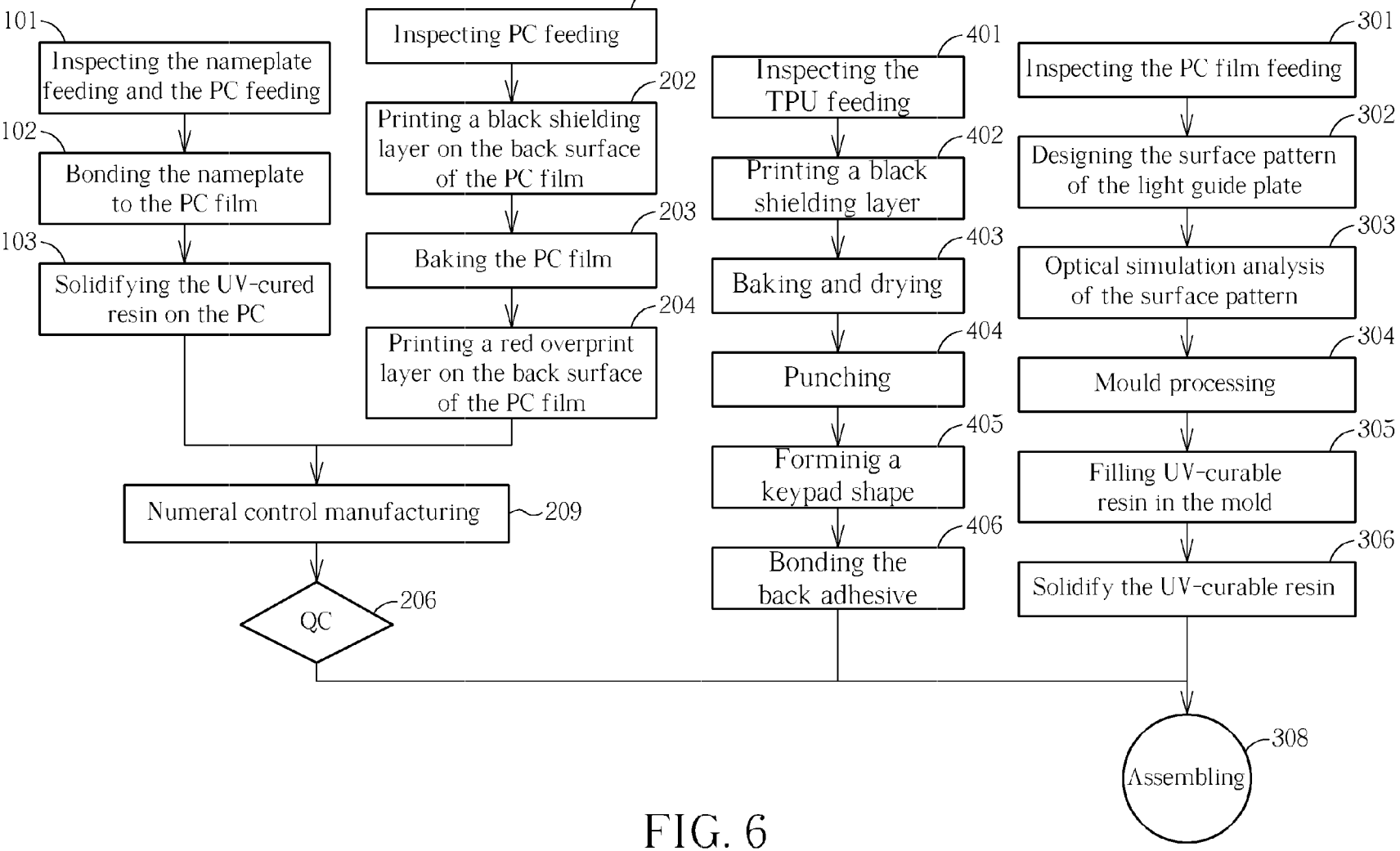
FIG. 6 is a flowchart illustrating a third embodiment of a method of manufacturing a keypad structure having a transparent keycap according to the present invention.

FIG. 6 is a flowchart illustrating the third embodiment of a method of manufacturing a keypad structure having a transparent keycap according to the present invention. In such embodiment, the keypad structure is assembled by virtue of the single keypads. Also, the thermoplastic polyurethane elastomer (TPU) layer is used. The step of forming keycap component is identical to the first embodiment illustrated in FIG. 4. Afterwards, step 209 is performed for forming the keycap component and the overprint component by numeral control manufacturing so as to punch the single keypads respectively. Then, step 206 is performed for quality control. The step of providing the light guide plate is identical to the first embodiment illustrated in FIG. 4. As for the use of TPU layer, firstly, step 401 is performed to inspect the TPU feeding. Step 402 is performed to print a black shielding layer, and step 403 is performed for baking and drying. Step 404 is performed for punching. Step 405 is subsequently performed to form a keypad shape. Step 406 is performed to bond the back adhesive. Afterwards, step 308 is performed so that the keycap component, the overprint component, TPU film and the light guide plate are assembled so as to form a keypad structure.

On the other hand, in the present invention, a keypad structure having a transparent keycap is provided. FIG. 7 to FIG. 10 are cross-sectional diagrams illustrating parts of the four embodiments of the keypad structure having a transparent keycap according to the present invention.

Figure 7:
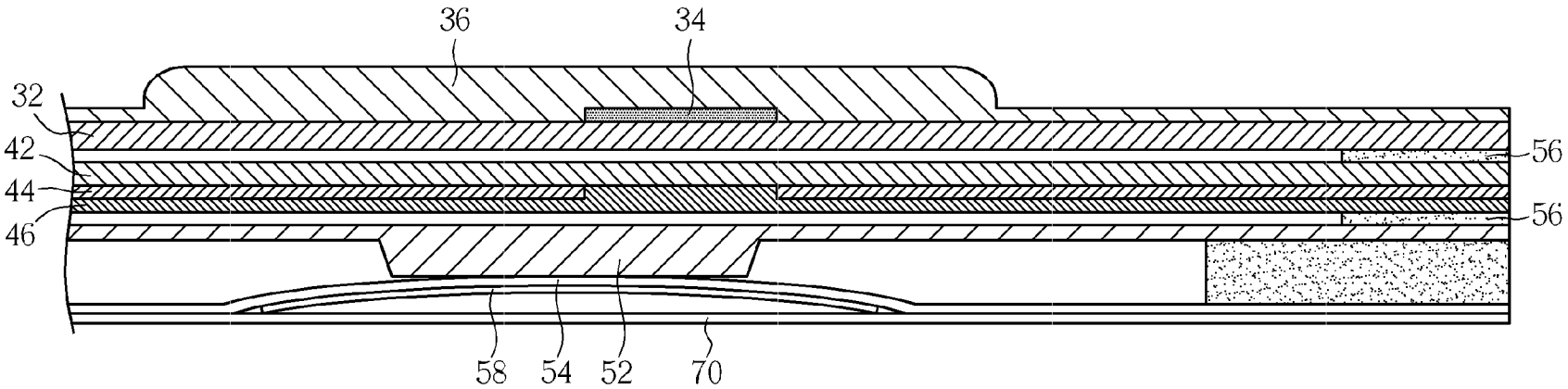
FIG. 7 to FIG. 10 are cross-sectional diagrams illustrating parts of the four embodiments of the keypad structure having a transparent keycap according to the present invention.

As illustrated in FIG. 7, the keypad structure having a transparent keycap includes a keycap component and an overprint component. The keycap component includes a first transparent resin layer 32, a first metal pattern layer 34 disposed on the upper surface of the first transparent resin layer 32, and a keycap layer 36 disposed on the upper surface of the first transparent resin layer 32. Also, the keycap layer 36 covers the first metal pattern layer 34. The overprint component includes a second transparent resin layer 42, and the upper surface of the second transparent resin layer 42 is bonded to the bottom surface of the first transparent resin layer 32 by virtue of using a double-sided adhesive tape 56. In addition, a first print layer 44 covers the bottom surface of the second transparent resin layer 42. A pattern of the first print layer complements a pattern of the first metal pattern layer, wherein the pattern of the first print layer and the pattern of the first metal pattern are a skeleton pattern and hollowed pattern respectively. Also, a second print layer 46 covers the first print layer 44.

FIG. 7 further illustrates a light guide plate 52, and the light guide plate 52 and the second print layer 46 of the second transparent resin layer 42 are bonded by virtue of using a double-sided adhesive tape 56. Also, the light guide plate 52 and the plunger are formed integrally. The light guide plate 52 is bonded to the metal dome 58 of a circuit board 70 via the plunger, such that whole structure is disposed on the circuit board. In addition, the metal dome 58 is bonded to the circuit board 70 by virtue of a metal dome adhesive sheet 54.

Figure 8:
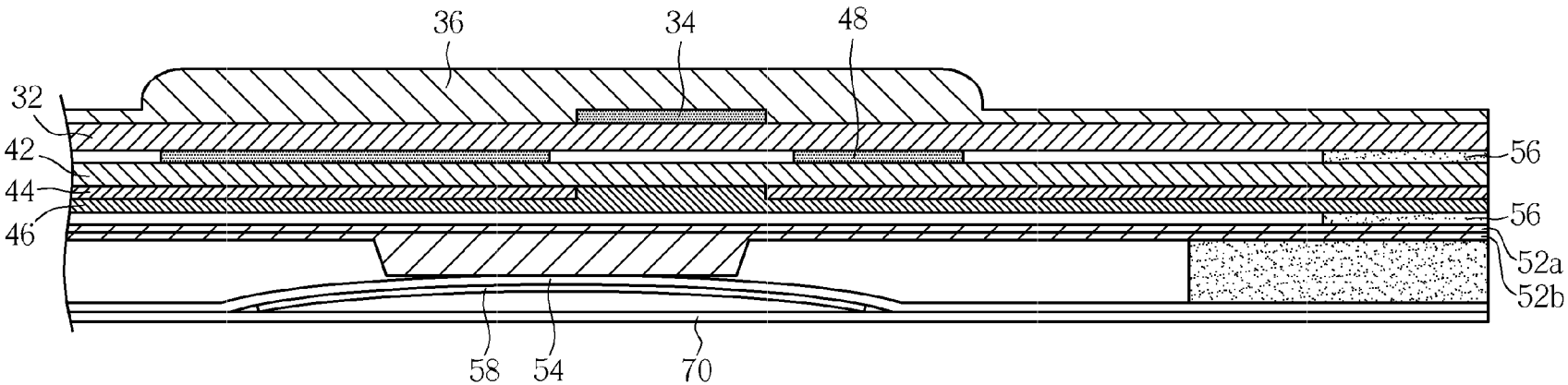

FIG. 8 illustrates the keypad structure having a transparent keycap, and the difference between FIG. 7 and FIG. 8 is that FIG. 8 further includes a second metal pattern layer 48. Also, the second metal pattern layer 48 has a hollowed pattern corresponding to the first metal pattern layer 34. As illustrated in FIG. 8, a gap between the second metal pattern layer 48 and the first metal pattern layer 34 after stacking is viewed in the projection direction. Also, parts of the first print layer 44 may be visible via the gap.

FIG. 8 further illustrates that the light guide plate may be a structure formed of two parts 52*a* and 52*b*. The two parts 52*a*, 52*b* may be polycarbonate film for optical use.

Figure 9:
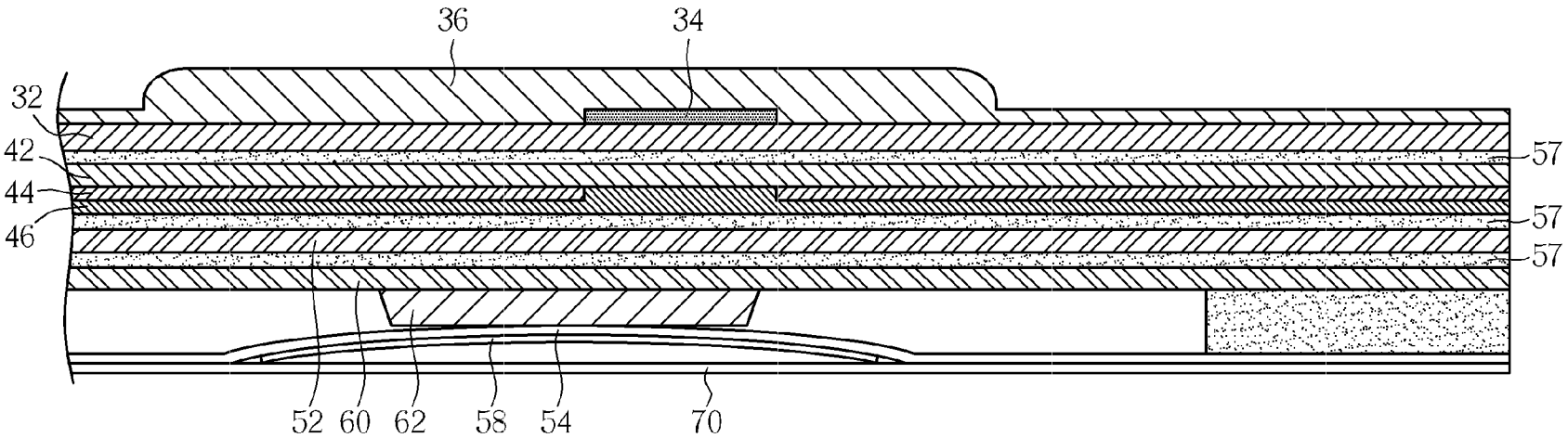

FIG. 9 illustrates the keypad structure having a transparent keycap, and the difference between FIG. 7 and FIG. 9 is that FIG. 9 further includes a capacitive touch plate 60 bonded to the bottom surface of the light guide plate 52. The capacitive touch plate 60 is bonded to a metal dome adhesive sheet 54 via the plunger 62. It should be noted that the adhesion layers 57 used for bonding each of the components are filled between all of the components, such that the occurrence of the gap which will interfere the touching function may be prevented.

Figure 10:
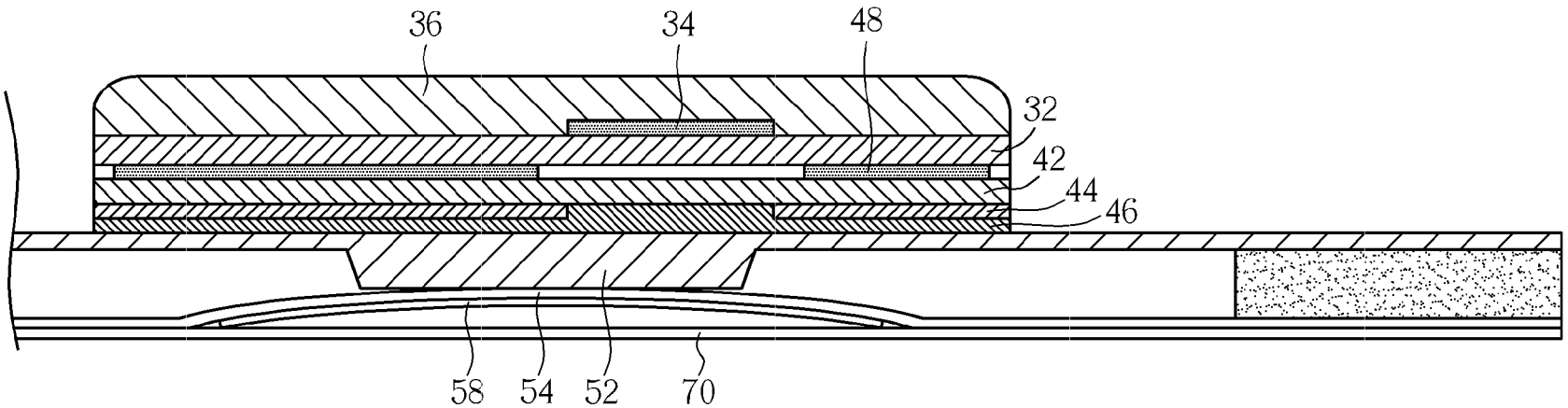

The aforementioned FIG. 7, FIG. 8 and FIG. 9 are cross-sectional diagrams illustrating parts of a keypad structure including the keycap component and the overprint component serving as a keypad shape. FIG. 10 is a cross-sectional diagram illustrating a part of a single keypad shape including the keycap component and the overprint component. The difference between FIG. 10 and FIG. 7 is that the keycap component and the overprint component illustrated by FIG. 10 are punched so as to form a single keypad shape and bonded to the light guide plate 52.

As the keypad structure illustrated in FIG. 10, the keypad structure may further include a transparent soft resin or rubber layer (not shown in the drawings) which may be bonded to the metal dome of the circuit board via a plurality of plungers respectively. The overprint component of each of the single keypads corresponds to the plunger and is disposed on the transparent soft resin or rubber layer, and each of the keycap components is disposed on each of the overprint component respectively. The soft resin or rubber layer may provide more comfort for users.

The present invention utilizes double overprints and two layers of thin films to generate level difference in height, such that the figures or patterns seem to be floated and are felt to be three-dimensional. Also, the capacitive touch plate may be further integrated into the structure with ease.

Those skilled in the art will readily observe that numerous modifications and alterations of the device and method may be made while retaining the teachings of the invention.

What is claimed is:

1. A method of manufacturing a keypad structure having a transparent keycap, comprising:

forming a keycap component, comprising:

providing a first transparent resin layer comprising a first surface and a second surface, forming a first metal pattern layer on the first surface of the first transparent resin layer, and forming a keycap layer covering the first metal pattern layer and on the first surface of the first transparent resin layer;

forming an overprint component, comprising:

providing a second transparent resin layer comprising a third surface and a fourth surface, forming a first print layer covering the fourth surface, a pattern of the first print layer complementing a pattern of the first metal pattern layer, and forming a second print layer covering the first print layer, wherein the pattern of the first print layer and the pattern of the first metal pattern layer are skeleton pattern and hollowed pattern respectively;

providing a light guide plate comprising a fifth surface and a sixth surface; and bonding the keycap component, the overprint component, and the light guide plate for assembly, wherein the second surface of the first transparent resin layer and the third surface of the second transparent resin layer face each other, and the fourth surface of the second transparent resin layer and the fifth surface of the light guide plate face each other.

2. The method of claim 1, further comprising:

providing a circuit board, the circuit board comprising at least a metal dome disposed thereon; and bonding a plunger to the sixth surface of the light guide plate, and bonding the light guide plate to the metal dome of the circuit board via the plunger.

3. The method of claim 1, wherein the sixth surface of the light guide plate and a plunger are formed integrally, and the method further comprises:

providing a circuit board, the circuit board comprising at least a metal dome disposed thereon; and bonding the sixth surface of the light guide plate to the metal dome of the circuit board via the plunger.

4. The method of claim 1, wherein a metal nameplate layer is bonded to the second surface of the first transparent resin layer so as to form the first metal pattern layer.

5. The method of claim 1, wherein a metal paint is printed on the second surface of the first transparent resin layer so as to form the first metal pattern layer.

6. The method of claim 1, wherein a metal layer is formed on the second surface of the first transparent resin layer by a sputtering process so as to form the first metal pattern layer.

7. The method of claim 1, further comprising forming a second metal pattern layer on the third surface of the second transparent resin layer, and the second metal pattern layer comprising a hollowed pattern opposite to a pattern of the first metal pattern layer.

8. The method of claim 1, wherein the step of bonding the keycap component, the overprint component and the light guide plate comprises using an adhesion layer between the keycap component and the overprint component and an adhesion layer between the overprint component and the light guide plate respectively for bonding.

9. The method of claim 1, wherein the keycap layer comprises a UV-cured resin.

10. The method of claim 1, further comprising disposing a light emitting diode chip on a side of the light guide plate.

11. The method of claim 1, wherein the keycap component and the overprint component are punched respectively so as to form a keypad shape and are bonded together to the light guide plate for assembly.

12. The method of claim 1, wherein the keycap component and the overprint component after being bonded together are punched so as to form a plurality of single keypads, a transparent rubber layer is provided so that at least one of the single keypads is bonded to the transparent rubber layer and the light guide plate for assembly, and the transparent rubber layer is disposed between the at least a single keypad and the light guide plate.

13. A keypad structure having a transparent keycap, comprising:

a keycap component comprising:

a first transparent resin layer comprising a first surface and a second surface, a first metal pattern layer disposed on the first surface of the first transparent resin layer, and a keycap layer disposed on the first surface of the first transparent resin layer and the keycap layer covering the first metal pattern layer; and an overprint component comprising:

a second transparent resin layer comprising a third surface and a fourth surface, a first print layer covering the fourth surface, a pattern of the first print layer complementing a pattern of the first metal pattern layer, and forming a second print layer covering the first print layer, wherein the pattern of the first print layer and the pattern of the first metal pattern layer are skeleton pattern and hollowed pattern respectively, wherein the keycap component and the overprint component are bonded together, and the second surface of the first transparent resin layer and the third surface of the second transparent resin layer face each other.

14. The keypad structure of claim 13, further comprising bonding a light guide plate and the overprint component, wherein the light guide plate comprises a fifth surface and a sixth surface, and the fifth surface and the fourth surface of the second transparent resin layer face each other.

15. The keypad structure of claim 14, wherein a light having color identical to the second print layer emitted from the second print layer in a backlight on mode and passes through the first print layer, the second transparent resin layer and the first transparent resin layer so that the pattern of the first metal pattern layer is set off by the second print layer.

16. The keypad structure of claim 14, further comprising:

a circuit board, the circuit board comprising at least a metal dome bonded to the sixth surface of the light guide plate via the plunger.

17. The keypad structure of claim 16, wherein the plunger and the sixth surface of the light guide plate are formed integrally.

18. The keypad structure of claim 14, wherein the keycap component, the overprint component and the light guide plate are bonded respectively by virtue of using an adhesion layer.

19. The keypad structure of claim 14, further comprising:

a capacitive touch plate bonded to the sixth surface of the light guide plate, and a circuit board, the circuit board comprising at least a metal dome bonded to the capacitive touch plate via a plunger.

20. The keypad structure of claim 13, wherein the first metal pattern layer comprises a metal nameplate layer, a metal print layer or a metal sputtering layer.

21. The keypad structure of claim 13, further comprising a second metal pattern layer disposed on the third surface of the second transparent resin layer, and the second metal pattern layer has a pattern corresponding to the first metal pattern layer.

22. The keypad structure of claim 21, wherein there is a gap between the second metal pattern layer and the first metal pattern layer in a projection view along the stacking direction of the second metal pattern layer and the first metal pattern layer, and a part of the first print layer or a part of the second print layer is visible via the gap.

23. The keypad structure of claim 13, wherein the keycap layer comprises a UV-cured resin.

24. The keypad structure of claim 13, wherein the first transparent resin layer comprises PC or PET.

25. The keypad structure of claim 13, wherein the second transparent resin layer comprises PC or PET.

26. The keypad structure of claim 13, further comprising a light emitting diode chip disposed on a side of the light guide plate.

27. A keypad structure having a transparent keycap, comprising:

a circuit board, the circuit board having a plurality of metal domes;

a transparent soft resin or a rubber layer bonded to the metal domes of the circuit board via a plurality of plungers;

a plurality of keycap components, each of the keycap components comprising:

a first transparent resin layer comprising a first surface and a second surface, a first metal pattern layer disposed on the first surface of the first transparent resin layer, and a keycap layer disposed on the first surface of the first transparent resin layer and covering the first metal pattern layer;

a plurality of overprint components, each of the overprint components comprising:

a second transparent resin layer comprising a third surface and a fourth surface, a first print layer covering the fourth surface and comprising a pattern complementing a pattern of the first metal pattern layer, wherein the pattern of the first print layer and the pattern of the first metal pattern are skeleton pattern and hollowed pattern respectively; and a second print layer covering the first print layer, wherein the fourth surface and the transparent soft resin or the rubber layer face each other, wherein the overprint components corresponding to the plungers respectively are disposed on the transparent soft resin or the rubber layer, the keycap components are disposed on the overprint component respectively, and the second surface of the first transparent resin layer and the third surface of the second transparent resin layer face each other.

* * * * *